United States Patent [19]

Imber

[11] 4,338,867

[45] Jul. 13, 1982

[54] TABLE ASSEMBLED WITHOUT FASTENERS

[75] Inventor: Marion Imber, Stamford, Conn.

[73] Assignee: Ray Control Corp., New York, N.Y.

[21] Appl. No.: 120,170

[22] Filed: Feb. 11, 1980

[51] Int. Cl.[3] ..... A47B 3/06

[52] U.S. Cl. ..... 108/159; 108/153; 248/188.91

[58] Field of Search ..... 108/159, 153, 156; 297/441, 440; 248/188, 188.91

[56] References Cited

U.S. PATENT DOCUMENTS

| | | | |
|---|---|---|---|
| 1,480,416 | 1/1924 | Pohl | 108/159 |
| 2,669,117 | 2/1954 | Furmann | 108/159 X |
| 2,677,470 | 5/1954 | Catalano | 108/156 X |
| 2,710,053 | 6/1955 | Hamilton | 248/188.91 X |
| 2,768,044 | 10/1956 | Jaffe | 108/156 |
| 3,180,685 | 4/1965 | Rogasski et al. | 297/441 |
| 3,751,789 | 8/1973 | Fink | 297/162 |
| 4,119,045 | 10/1978 | Michelotti | 108/156 |

FOREIGN PATENT DOCUMENTS

| | | | |
|---|---|---|---|
| 253419 | 7/1964 | Australia | 108/152 |
| 535684 | 9/1931 | Fed. Rep. of Germany | 108/159 |
| 674881 | 10/1929 | France | 108/159 |
| 1134369 | 12/1956 | France | 108/159 |
| 320703 | 4/1957 | Switzerland | 108/159 |
| 1375891 | 11/1974 | United Kingdom | 108/159 |

*Primary Examiner*—James T. McCall

*Attorney, Agent, or Firm*—Blum, Kaplan, Friedman, Silberman and Beran

[57] ABSTRACT

A structurally sound table is readily assembled without use of fasteners. Legs seat in inwardly canted sockets integral with the table top, and a spreader ring presses the legs outwardly into frictional contact with the socket walls, preventing disengagement. The table is readily disassembled.

12 Claims, 5 Drawing Figures

TABLE ASSEMBLED WITHOUT FASTENERS

BACKGROUND OF THE INVENTION

This invention relates generally to a table and more particularly to a table which can be assembled and disassembled from basic elements without the use of fasteners. Tables are usually shipped from the manufacturer or from the showroom in a knocked-down condition. Considerable time and effort and a plurality of fasteners are generally needed to assemble the components into a rigidized, usable table structure. It is not uncommon that the package of fasteners, described in the assembly instructions, is entirely missing or incomplete. Further, purchasers buying an unassembled piece of furniture frequently lack the tools to complete the proper assembly.

What is needed is a table which is structurally sound and yet is readily assembled without the need for tools or fasteners.

SUMMARY OF THE INVENTION

Generally speaking, in accordance with the invention, a table especially suitable for assembly and disassembly without fasteners or the use of tools is provided. Legs seat in inwardly canted sockets integral with the table top, and a spreader ring presses the legs into frictional contact with the socket walls, preventing disengagement. The table top may be round, square, oval or any regular polygon.

Accordingly, it is an object of this invention to provide an improved table which can be disassembled without the need for tools.

Another object of this invention is to provide an improved table which is held together without the need for fasteners.

Still another object of this invention is to provide an improved table which is pleasing in appearance due to the absence of fasteners.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which.

DESCRIPTION OF THE PREFERRED EMBODIMENTS

Figure 1:
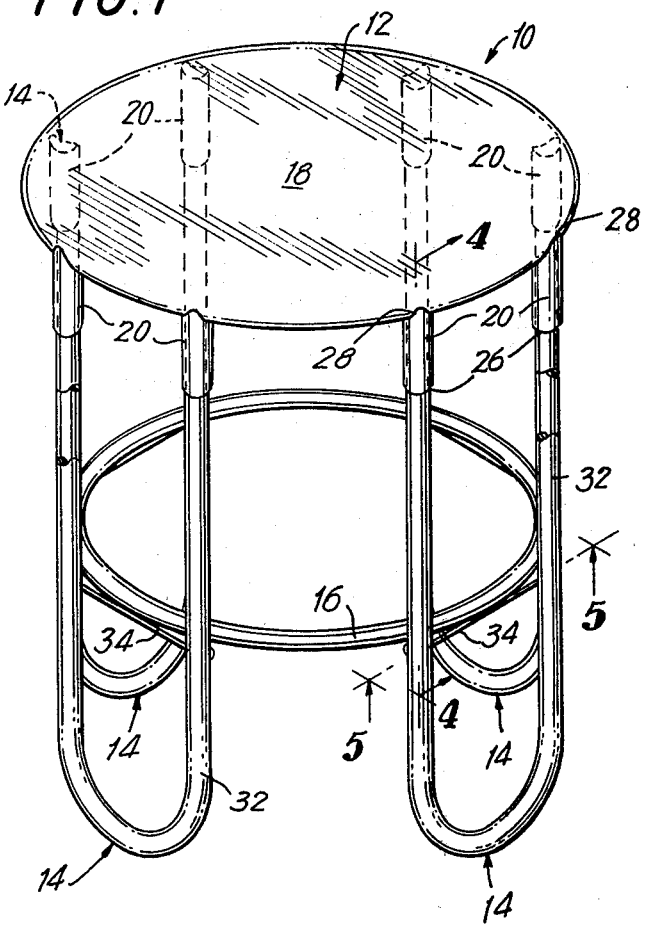
FIG. 1 is a top perspective view of a table in accordance with this invention.
Figure 1:
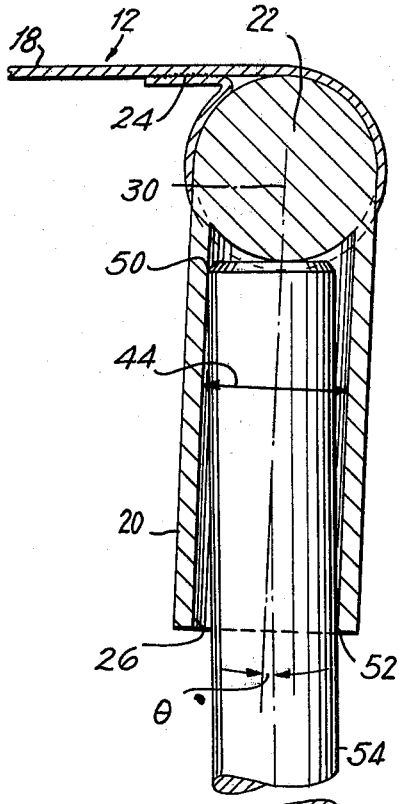

With reference to the Figures, the table 10 in accordance with this invention is comprised of a top assembly 12, four leg assemblies 14 and a spreader ring 16.

The table top assembly 12 includes the table top and four pairs of sockets 20 attached to a circular ring 22. The table top 18 is attached to the ring 22. In the embodiment shown in the drawings, the table top 18 is a thin sheet of a rigid or semirigid material such as, for example, plastic or woven rattan, which wraps around the circular ring 22 and is joined to itself in any suitable manner along a joint 24. When, for example, the top 18 is made of rattan strands, the joint 24 may be completed by a weaving through openings in the rattan using similar materials for joining. When the top 18 is made, for example, of plastic or metal, the joint may be accomplished, for example, by welding, thermal fusion, rivets, etc.

The sockets 20 are cylindrical tubes of rigid material, for example, metal, plastic, which are open at the lower ends 26 and attached to the lower (FIG. 4) portion of the circular ring 22. The upper ends 28 of the sockets 20 are contoured for a recessed fit with the circular ring 22. The sockets 20 are fixedly attached to the circular ring 22, and the longitudinal axis 30 cants inwardly and downwardly, making an angle $\theta$ between the socket 20 and the vertical. Values of theta in a range of 0–10 degrees have been used with satisfactory results.

The sockets 20 are spaced apart in pairs and the socket pairs are uniformly distributed around the periphery of the circular ring 22.

Figure 5:
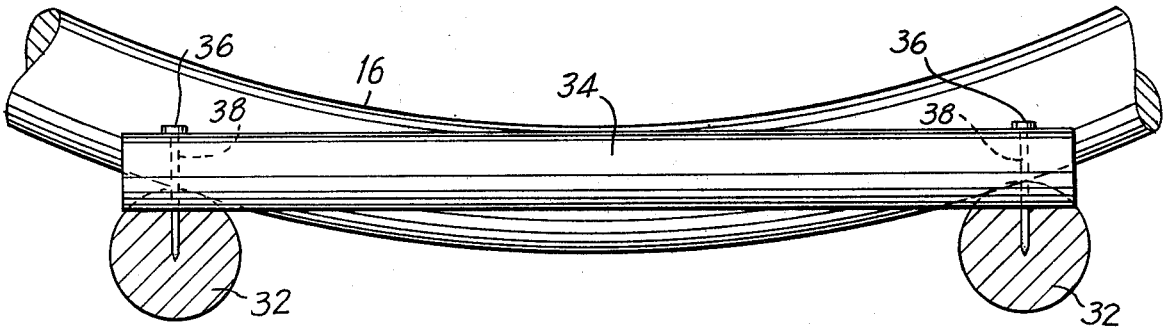
FIG. 5 is a sectional view taken along line 5—5 of FIG. 1.
Figure 2:
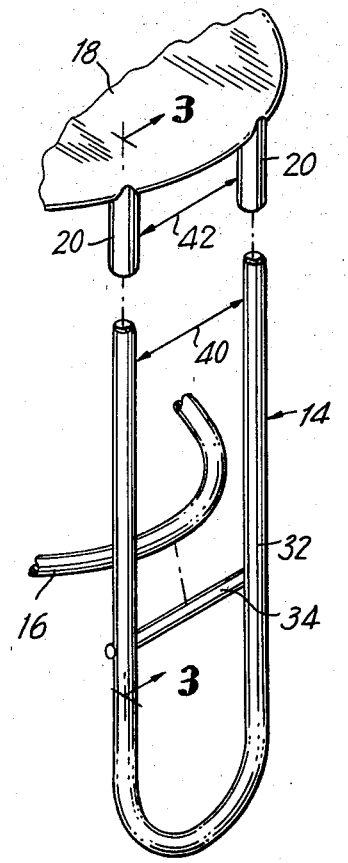
FIG. 2 is a fragmentary portion of the table of FIG. 1 in an exploded view.
Figure 3:
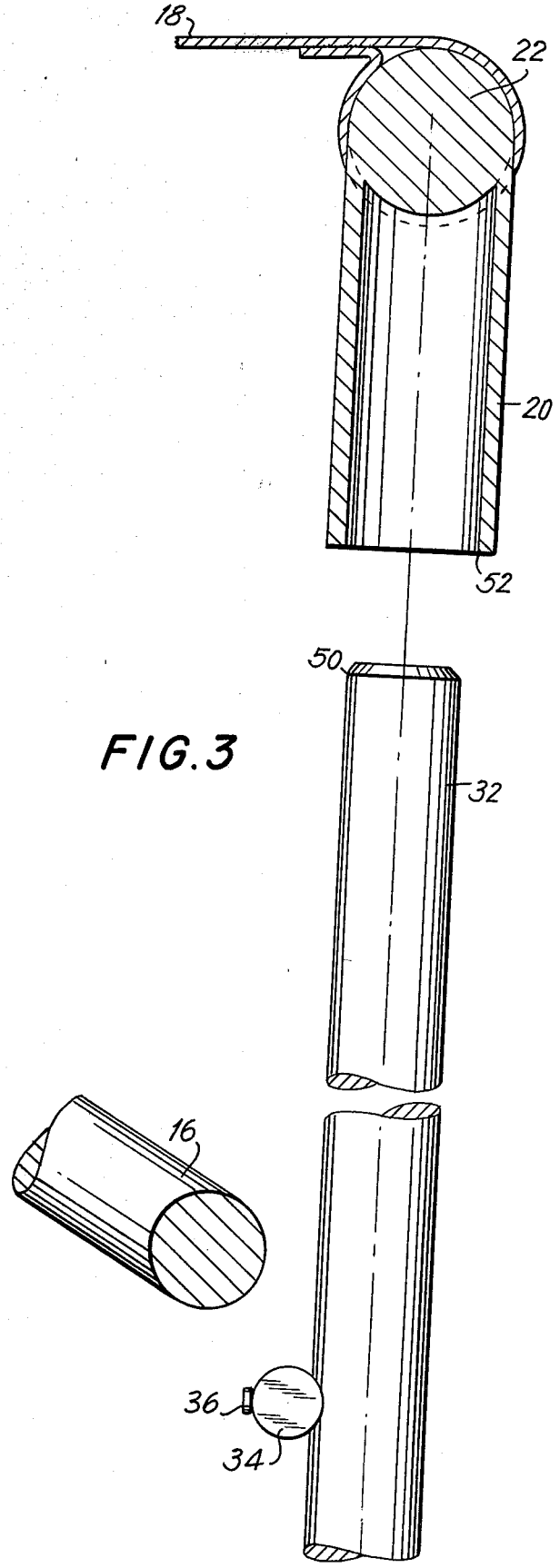
FIG. 3 is a view, partly in section, taken along line 3—3 of FIG. 2.

The four leg assemblies 14 are similar. For this reason, the description of one leg assembly 14 is equally applicable to the other leg assemblies 14. The leg assembly 14 is comprised of a U-shaped member 32 and a strut 34 spanning the distance 40 between the branches of the U-shaped member 32 in a symmetrical fashion, that is, the strut 34 joins transversely with the branch members of the U. The strut 34 is fixedly attached to the U-shaped member 32 by means of a headed fastener 36 at each end of the strut 34, passing through holes 38 in the strut 34 and engaging the U-shaped member 32. FIG. 5 illustrates a nail used as the fastener 36. The linear spacing 40 between the branches of the U-shaped member 32 substantially equals the linear spacing 42 between the sockets 20 in a pair of sockets 20. Further, the inside diameter 44 of the sockets 20 is greater than the outside diameter 46 of the branches of the U-shaped member 32.

Figure 4:
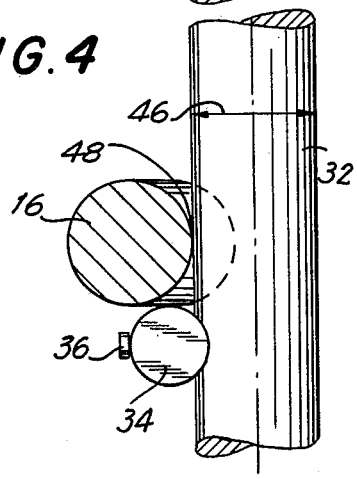
FIG. 4 is a view, partly in section, taken along line 4—4 of FIG. 1.

The spreader ring 16 is a continuous circle of tubular material which fits beneath the table top 18 and presses on the inside surfaces 48 (FIG. 4) of the branches of the U-shaped members 32. The diameter of the spreader ring 16 is related to the diameter of the circular ring 22 such that the leg assemblies 14, inserted into the canted sockets 20, are forced outwardly into a substantially vertical orientation. As seen in FIG. 4, in this condition, the inner surface 48 of the leg assembly branches of the U-shaped member 32 is in contact with the inner surface of the socket 20 at its upper end 50, and the lower end of the socket 52 is in contact with the outer surface 54 of the branches of the U-shaped member 32.

The leg struts 34 are on the inward side of the U-shaped members 32 as assembled in the sockets 20 and provide a platform upon which the spreader ring 16 rests so that it is not displaced by the force of gravity in the downward direction.

Thus, the table 10 according to this invention is rigidized. If lifted from the floor by gripping the table top 18 along its edges, the leg assemblies 14 remain seated in their respective sockets 20 because of the frictional contact at two points between the outer surfaces of the U-shaped members 32 and the inner surfaces of the sockets 20. This condition is maintained by the outward force exerted on the leg assemblies 14 by the spreader ring 16. As stated above, the spreader ring in turn maintains its position by resting upon the struts 34.

The table components, including the top assembly 12, four leg assemblies 14 and the spreader ring 16, are readily assembled by inserting the free ends of the U-shaped members 32 into pairs of sockets 20. This may be done with the table top 18 upright or inverted or at any suitable angle. The spreader ring 16 is placed at an angle between the leg assemblies 14 and then turned to a position between the table top 18 and the struts 34. Finally, the spreader ring 16 is placed in a position parallel with the table top 18 and pressed onto the struts 34 to force the leg assemblies 14 outwardly into the aforesaid frictional contact with the sockets 20.

To disassemble the table, a small force urging the spreader ring 16 in the direction of the table top 18 releases the spreader ring from contact with at least one leg assembly 14. The spreader ring 16 is then turned and removed, and the leg assemblies 14 are pulled from the sockets 20.

It should be understood that in alternative embodiments of this invention, the table top 18, which has been illustrated in the Figures in a circular configuration, may have a shape other than circular, for example, square, oval, etc. Locating the sockets on the lower side of the table top 18 at points around a circle will provide for proper positioning and attachment of the legs regardless of the shape of the table top. Further, in other alternative embodiments of this invention, the number of leg assemblies may be more or less than the four which have been illustrated. When the sockets 20 are located on a common circle, a single spreader ring 16 will engage and stress all of the leg assemblies 14. Further, in another alternative embodiment of this invention, the table top 18 may be thick such that the sockets 20 may be attached directly to the table top without need for the circular ring 22. Also in another alternative embodiment of this invention, the thickness of the table top may permit the leg assemblies to be seated directly in canted holes in the table top rather than in independent socket pieces as described above.

It will thus be seen that the objects set forth above, and those made apparent from the preceding description, are efficiently attained, and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A table comprising:

a top;

a plurality of engagement means, each said engagement means being connected to said top and extending downwardly therefrom in a direction approximately perpendicular to said top;

a plurality of legs, each leg being connected with one of said engagement means; and spreader means contacting said legs and pushing said legs into frictional contact with surface portions of said engagement means to frictionally connect each leg to its associated engagement means, said spreader means not being joined to said legs and being compressively acted upon by said legs, said legs being unconstrained from separation from said engagement means when said spreader means does not push said legs.

2. A table as claimed in claim 1 and further comprising strut means for locating said spreader means vertically in relation to said legs when said table is in a normal, upright position.

3. A table as claimed in claim 2, wherein said strut means are attached to said legs.

4. A table as claimed in claim 3, wherein said spreader means engages said legs at points intermediate said top and said strut means.

5. A table comprising:

a top;

a plurality of engagement means, each said engagement means being connected to said top and canted downwardly and inwardly therefrom in a direction approximately perpendicular to said top;

a plurality of vertical legs, each leg being connected with one of said canted engagement means; and spreader means contacting said legs and pushing said legs into frictional contact with surface portions of said engagement means to frictionally connect each leg to its associated engagement means, said spreader means not being joined to said legs and being compressively acted upon by said legs;

strut means attached to said legs for locating said spreader means vertically in relation to said legs when said table is in a normal upright position, said spreader means engaging said legs at points intermediate said top and said strut means.

6. The table as claimed in claim 5, wherein said engagement means are distributed around a circle.

7. The table as claimed in claim 6, wherein said spreader means is a circular ring.

8. The table as claimed in claim 7, wherein each said leg includes two generally parallel elements, and said strut means is connected between said generally parallel elements.

9. The table as claimed in claim 5 or 8, wherein said engagement means are sockets and said legs are seated in said sockets.

10. The table as claimed in claim 1 or 5, wherein said top includes a top surface portion and a circular ring supporting said top surface portion, said engagement means being connected to said circular ring.

11. A table assembled without the use of tools, comprising a top member, a plurality of socket members carried by said top member, each said socket member having a longitudinal axis extending generally perpendicularly to the plane of said top member, a plurality of U-shaped legs, each leg having a pair of free ends, each pair of free ends being slidably positioned in a pair of socket members, a spreader engaging said U-shaped legs and forcing them apart with respect to one another to cause frictional engagement between each said free end and the socket number which receives it, said spreader not being joined to said legs and being compressively acted upon by said legs, said legs being unconstrained from separation from said socket members when said spreader does not force said legs apart, and struts on each U-shaped leg engaged by said spreader.

12. A table as claimed in claim 11, wherein the longitudinal axes of said socket members are convergent and said legs are vertical.

* * * * *